US006773752B2

(12) United States Patent
Lo

(10) Patent No.: US 6,773,752 B2
(45) Date of Patent: Aug. 10, 2004

(54) METHOD FOR MAKING SYNTHETIC LEATHER

(75) Inventor: Hsi-Chin Lo, Taichung Hsien (TW)

(73) Assignee: Feng Shern Enterprise Co., Ltd., Taichung Hsien (TW)

( * ) Notice: Subject to any disclaimer, the term of this patent is extended or adjusted under 35 U.S.C. 154(b) by 107 days.

(21) Appl. No.: 10/283,583

(22) Filed: Oct. 30, 2002

(65) Prior Publication Data

US 2004/0086651 A1 May 6, 2004

(51) Int. Cl.[7] ..... B05D 3/02

(52) U.S. Cl. ..... 427/341; 427/342; 427/355; 427/389.9

(58) Field of Search ..... 427/355, 341, 427/342, 389.9

(56) References Cited

FOREIGN PATENT DOCUMENTS

| | | | |
|---|---|---|---|
| JP | 52-151702 | * | 12/1977 |
| JP | 53-044603 | * | 4/1978 |
| JP | 02-145877 | * | 6/1990 |
| JP | 07-197383 | * | 5/1995 |
| TW | 467984 | * | 12/2001 |
| WO | WO 00/28125 | * | 5/2000 |

* cited by examiner

*Primary Examiner*—Erma Cameron
(74) *Attorney, Agent, or Firm*—Ladas & Parry

(57) ABSTRACT

A method for making synthetic leather includes the steps of: preparing a knitted substrate having a longitudinal direction and a transverse direction transverse to the longitudinal direction, the knitted substrate being stretchable in the longitudinal and transverse directions; positioning two opposite sides of the knitted substrate along the longitudinal direction respectively on two conveyer chains and advancing the knitted substrate without tensioning the substrate along the longitudinal direction; and forming a coating on the knitted substrate by applying a polyurethane solution on the knitted substrate.

7 Claims, 4 Drawing Sheets

METHOD FOR MAKING SYNTHETIC LEATHER

BACKGROUND OF THE INVENTION

1. Field of the Invention

The invention relates to a method for making synthetic leather, more particularly to a method for making synthetic leather that is stretchable in longitudinal and transverse directions.

2. Description of the Related Art

A conventional method for making synthetic leather includes the steps of applying a polyurethane resin on an unstretchable substrate, wet foaming the resin, separating the foamed resin from the substrate, and adhering the foamed resin to an elastic substrate. However, the method can not be carried out in a continuous process. Furthermore, when the foamed resin is adhered to the elastic substrate, it is difficult to control tension therebetween, which in turn results in an uneven tension distribution of the resultant product.

Another conventional method for making synthetic elastic leather includes the steps of adhering an elastic substrate containing elastic fibers to an unstretchable base fabric, conducting a wet process of the synthesis leather, and stripping the base fabric from the elastic substrate. However, the processing procedure of this method is relatively complicated, and is thus time-wasting and costly.

Although synthetic leather is broadly used in various applications, such as clothes, shoes, furnitures, automobiles, etc., the conventional synthetic leather is not stretchable in longitudinal and transverse directions, which will make the user feel uncomfortable and/or restrict the application thereof.

SUMMARY OF THE INVENTION

Therefore, the object of the present invention is to provide a method for making synthetic leather that is stretchable in longitudinal and transverse directions.

Accordingly, the method for making synthetic leather according to this invention includes the steps of:

- preparing a knitted substrate having a longitudinal direction and a transverse direction transverse to the longitudinal direction, the knitted substrate being stretchable in the longitudinal and transverse directions;
- positioning two opposite sides of the knitted substrate along the longitudinal direction respectively on two conveyer chains, and advancing the knitted substrate without tensioning the substrate along the longitudinal direction; and
- forming a coating on the knitted substrate by applying a polyurethane solution on the knitted substrate.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENTS

Figure 1:
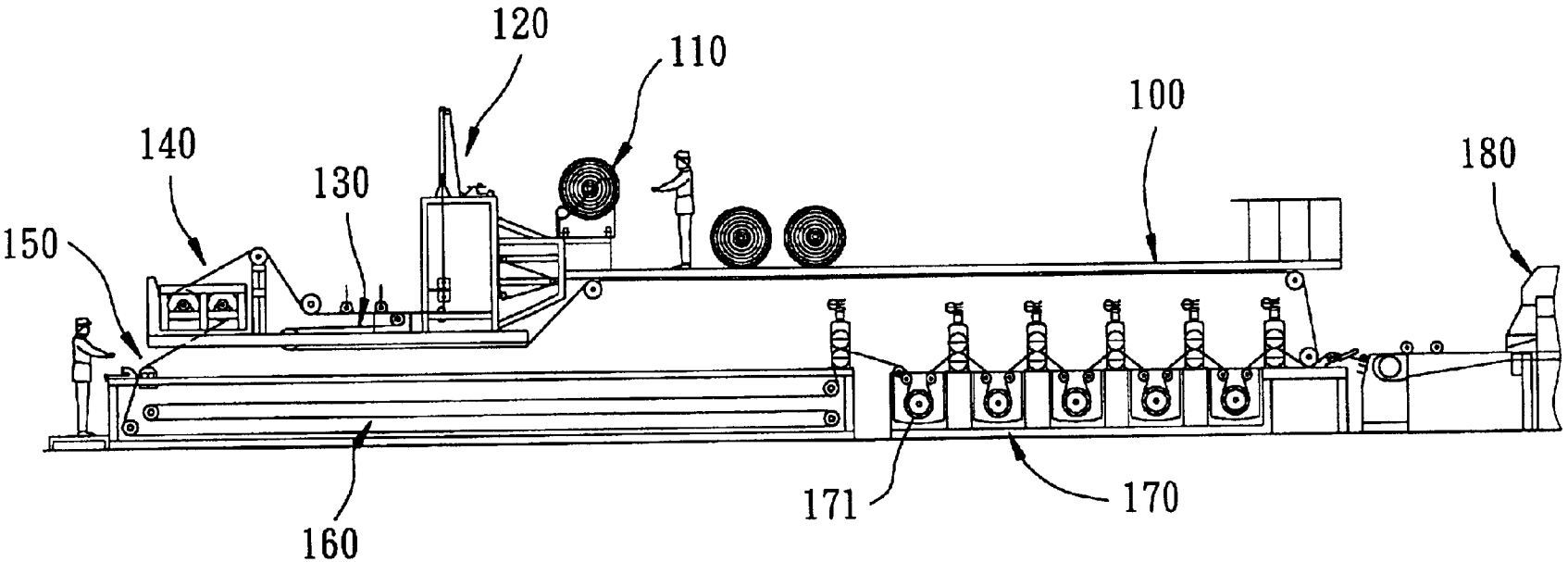
FIG. 1 is a schematic view of a system for implementing the preferred embodiment of the method for making synthetic leather according to this invention.
Figure 3:
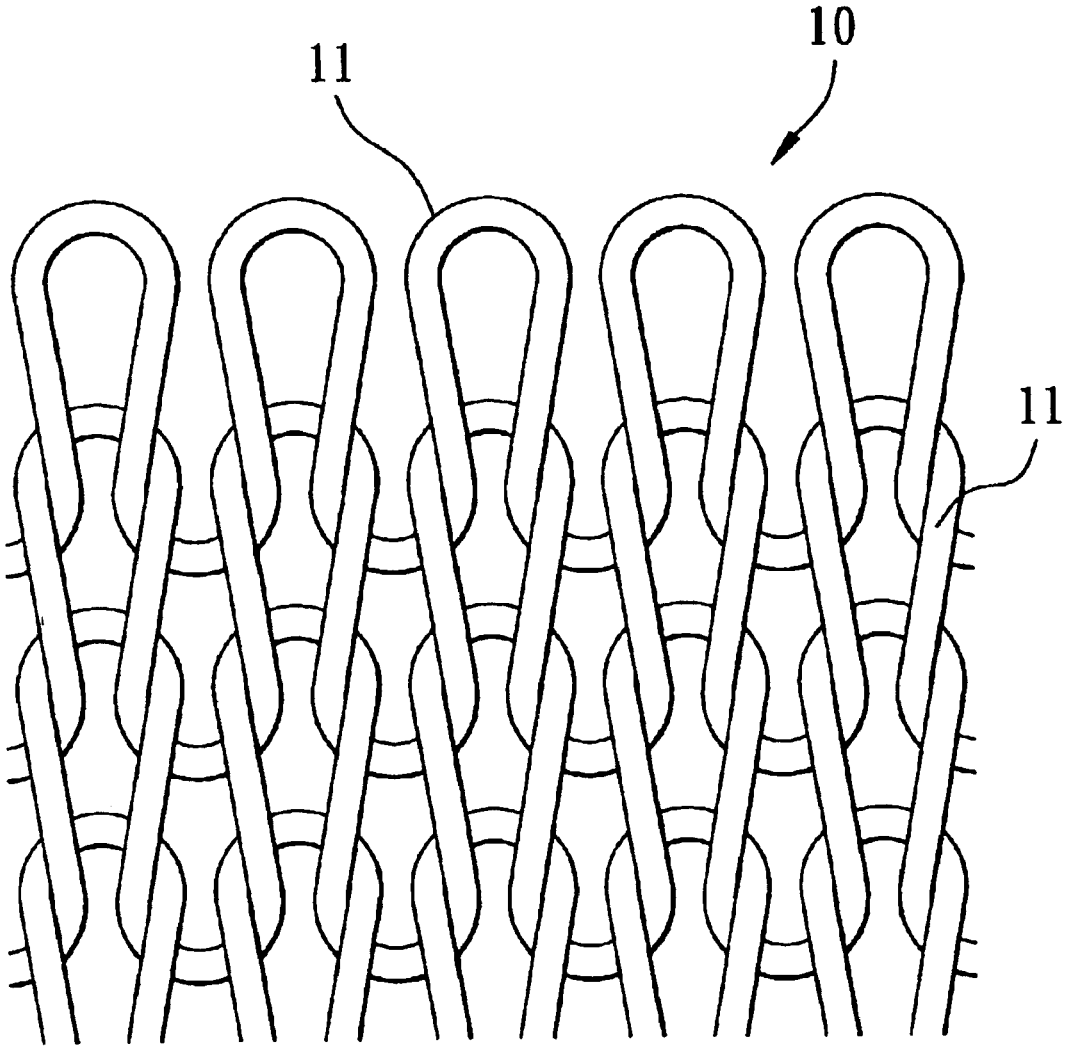
FIG. 3 is a schematic fragmentary view of a knitted substrate used in the preferred embodiment of the method for making synthetic leather according to this invention.

FIG. 1 illustrates a system for implementing the preferred embodiment of the method for making synthetic leather according to this invention. The preferred embodiment of the present method includes the steps of:

(A) Preparing a Knitted Substrate:

Referring to FIG. 3, a knitted substrate 10 is prepared, which has a longitudinal direction and a transverse direction transverse to the longitudinal direction. The knitted substrate 10 is stretchable in the longitudinal and transverse directions. The knitted substrate 10 is made of non-elastic natural or synthetic fibers in a stitch pattern, such as stocking stitch or rib stitch. The knitted substrate 10 includes a plurality of loops 11, which are interlaced with each other and which are spaced apart from each other.

(B) Mounting the Knitted Substrate 10 on a Take-off Roller 110:

The knitted substrate 10 is then mounted on a take-off roller 110. The take-off roller 110 is driven by a power device to unwind the knitted substrate 10 without tensioning the knitted substrate 10.

(C) Spreading:

The knitted substrate 10 is then spread by a cloth spreader 120.

Figure 2:
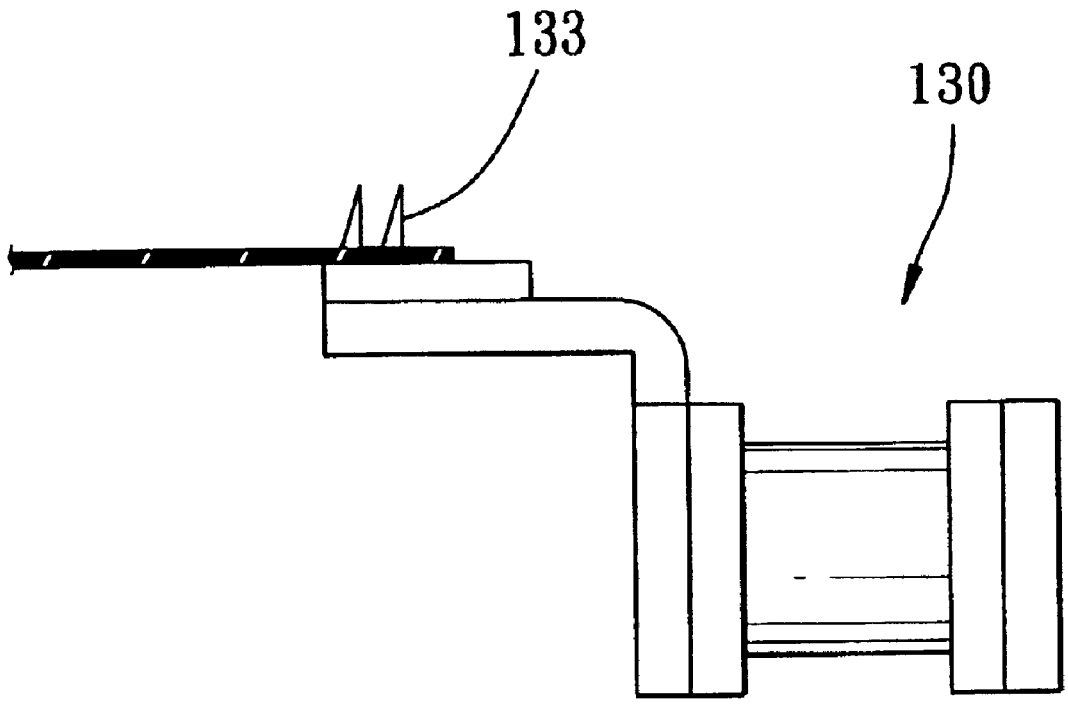
FIG. 2 is a schematic view showing conveyer chains used in the system of FIG. 1.

(D) Positioning and Advancing:

The two opposite sides of the knitted substrate 10 along the longitudinal direction are positioned respectively on teeth 133 (see FIG. 2) of two conveyer chains 130 by engaging the loops 11 of the knitted substrate 10 with the teeth 133 of the conveyer chains 130, and the knitted substrate 10 is then advanced without tensioning the knitted substrate 10 along the longitudinal direction.

(E) Ironing:

The knitted substrate 10 advanced by the conveyer chains 130 is ironed by an ironing device 140 so as to flatten the knitted substrate 10.

(F) Coating:

The flattened knitted substrate 10 is applied with a polyurethane solution by a coating device 150 so as to form a coating thereon. The polyurethane solution comprises a specific ratio of polyurethane in a suitable solvent, such as dimethyl formamide. The solid content in the solution ranges from 5% to 20%. If desired, optional additives, such as lignocellulose, cationic surfactant, anionic surfactant, pigment, etc., may be added to the solution.

Figure 4:
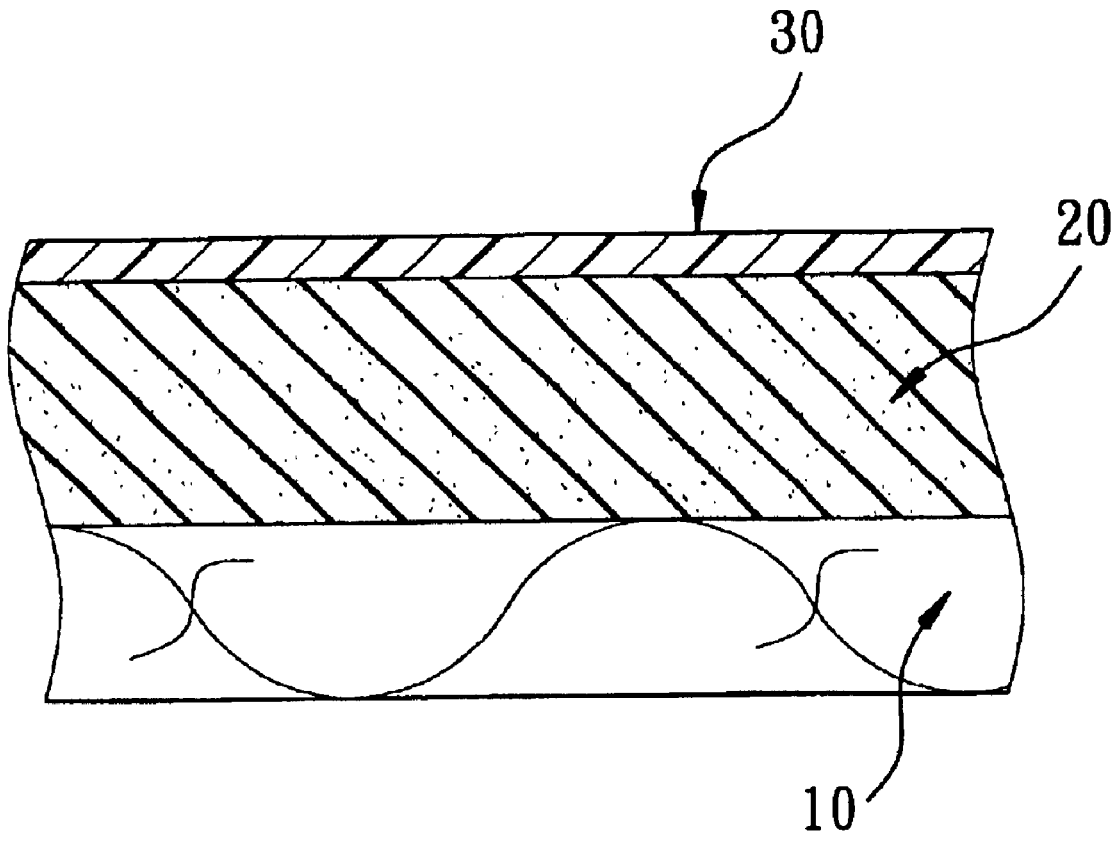
FIG. 4 is a schematic fragmentary sectional view of a product made by the preferred embodiment of the method for making synthetic leather according to this invention.

(G) Hardening:

The coated and knitted substrate is then dipped in an aqueous dimethyl formamide solution contained in a trough 160 so as to harden the coating and to form pores in the coating. The dipping time usually ranges from 5 to 10 minutes. The aqueous dimethyl formamide solution contains up to 30% of dimethyl formamide. The pores in the coating are formed by displacing the solvent in the coating with water in the aqueous dimethyl formamide solution. As a result, a foam layer 20 is formed on the knitted substrate 10, as best shown in FIG. 4.

(H) Washing:

The coated and knitted substrate is then conveyed by the conveyer chains 130 toward a washing device 170. The washing device 170 contains a plurality of hollow rollers 171, each of which is provided with a plurality of pores. The coated and knitted substrate is washed with water sprayed via the pores of the rollers 171 of the washing device 170 so as to remove residual dimethyl formamide on the coated and knitted substrate.

(I) Drying:

Finally, the coated and knitted substrate is dried by a drying device 180 so as to obtain the synthetic leather product.

Referring once again to FIG. 4, the synthetic leather contains the knitted substrate 10 and a foam coating 20. Since the knitted substrate 10 is stretchable in both longitudinal and transverse directions, and since the foam coating 20 is elastic, the synthetic leather made by the present method is stretchable in both longitudinal and transverse directions. The strechability in the londitudinal and transverse direction can be up to at least 10%. Therefore, the aforemensioned drawbacks encountered in the conventional synthetic leather can be overcome. Additionally, a skin layer 30 can be formed on the foam coating 20, and can be further processed by any suitable procedure, such as printing, rubbing, compressing, etc. so as to obtain the leather appearance.

In view of the aforesaid, a synthetic leather with the advantages, such as enhanced elasticity in the longitudinal and transverse directions, can be made with relative ease by the method of the present invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A method for making synthetic leather, comprising the steps of:

preparing a knitted substrate having a longitudinal direction and a transverse direction transverse to said longitudinal direction, said knitted substrate being stretchable in said longitudinal and transverse directions;

positioning two opposite sides of said knitted substrate along said longitudinal direction respectively on two conveyer chains, and advancing said knitted substrate without tensioning said substrate along said longitudinal direction; and forming a coating on said knitted substrate by applying a polyurethane solution on said knitted substrate.

2. The method as claimed in claim 1, further comprising steps of dipping said coated and knitted substrate in an aqueous dimethyl formamide solution so as to harden said coating and to form pores in said coating; and washing said coated and knitted substrate with water so as to remove residual dimethyl formamide on said coated and knitted substrate.

3. The method as claimed in claim 1, wherein said knitted substrate is made of non-elastic fiber.

4. The method as claimed in claim 1, further comprising a step of mounting said knitted substrate on a take-off roller and driving said take-off roller to unwind said knitted substrate before positioning said two opposite sides of said knitted substrate on said two conveyer chains.

5. The method as claimed in claim 1, wherein said substrate has a plurality of loops, said conveyer chains having a plurality of teeth to engage respectively said loops.

6. The method as claimed in claim 1, further comprising a step of ironing said knitted substrate before forming said coating on said knitted substrate.

7. The method as claimed in claim 2, further comprising a step of drying said coated and knitted substrate after washing said coated and knitted substrate with water.

* * * * *